United States Patent [19]

Eckert

[11] 4,270,290

[45] * Jun. 2, 1981

[54] REVOLVING SELF-SERVICE DISPLAY STAND

[75] Inventor: Ronald P. Eckert, Northbrook, Ill.

[73] Assignee: DLM, Inc., Niles, Ill.

[ * ] Notice: The portion of the term of this patent subsequent to Jul. 25, 1995, has been disclaimed.

[21] Appl. No.: 919,235

[22] Filed: Jun. 26, 1978

Related U.S. Application Data

[63] Continuation-in-part of Ser. No. 703,958, Jul. 9, 1976, Pat. No. 4,102,069.

[51] Int. Cl.[3] ..... B42F 17/20; G09F 11/02

[52] U.S. Cl. ..... 40/389; 40/403; 40/405; 40/497; 40/530; 40/535; 40/537; 211/58; 211/169

[58] Field of Search ..... 40/389, 390, 403, 404, 40/405, 489, 490, 491, 493, 497, 530, 535, 537, 154, 156, 158 R, 159; 211/50, 165, 169, 58

[56] References Cited

U.S. PATENT DOCUMENTS

| | | | |
|---|---|---|---|
| 3,277,598 | 10/1966 | Lightburn | 40/158 R |
| 3,727,334 | 4/1973 | Sakamoto | 40/158 R X |
| 3,958,348 | 5/1976 | Sakamoto | 40/158 R X |
| 4,102,069 | 7/1978 | Eckert | 40/497 |

*Primary Examiner*—John F. Pitrelli
*Assistant Examiner*—G. Lee Skillington
*Attorney, Agent, or Firm*—Wegner, Stellman, McCord, Wood & Dalton

[57] ABSTRACT

A frame for a self-service sales display device is provided with pockets on each side of the frame. Guide members are provided on the entry side or wall of the frame and on the side or wall of the frame opposite the entry side for guiding the flat members into and out of the pockets in the frame. A cutout is provided through the entry wall into each pocket for ease in gripping the edge of a poster or flat member for removal from the frame. The frames have shaped pivots which extend into openings formed in surfaces of the display device such that the frame can be pivoted into a picture book position on the device.

2 Claims, 14 Drawing Figures

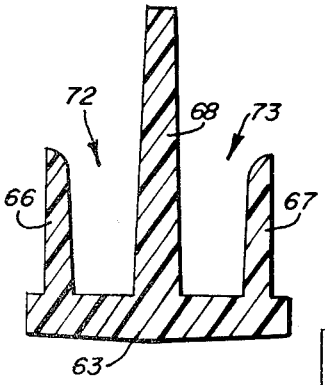
FIG. 4
FIG. 5
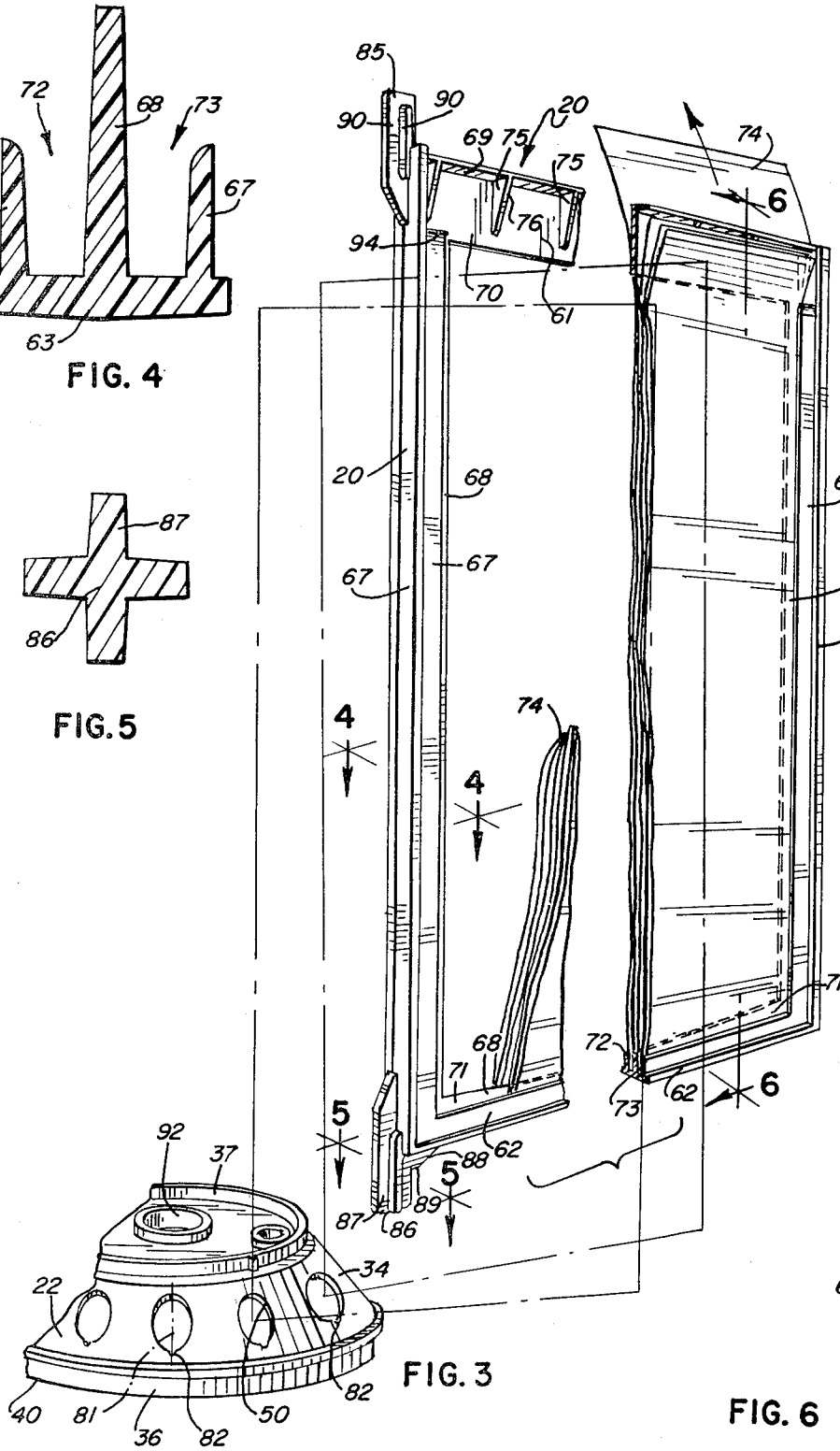
FIG. 3
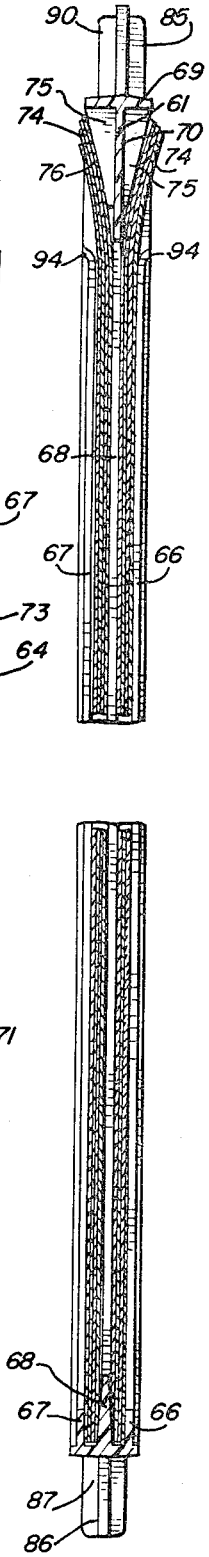
FIG. 6

REVOLVING SELF-SERVICE DISPLAY STAND

This application is a continuation-in-part application of application Ser. No. 703,958 filed July 9, 1976 now U.S. Pat. No. 4,102,069, issued July 25, 1978.

BACKGROUND OF THE INVENTION

1. Field of the Invention

This invention relates to sales display devices and, more particularly, to a novel entry and guide structure for adding or removing flat members to or from pockets in the frame.

2. Description of the Prior Art

Devices for displaying flat sheet material, such as posters and the like, are in current use. Some of said devices have a vertical pedestal from which a plurality of frames project outwardly. Each frame is made up of metal strips forming a pocket in which flat material, such as posters, are stored so that the front poster is visible. The frames are pivotally mounted on pivots such that a viewer can pivot one frame after another as the front poster in each frame is viewed. After a viewer selects a poster, it is necessary to thread the poster up and out of the frame, which threading necessitates first a short vertical movement, then a bending forward of the top of the poster, and then further vertical movement, all of which can cause the poster to crease, crack, tear or become fingerprinted and soiled from all the manipulation needed to remove the poster from the frame.

The frames for displaying posters are metal while frames for displaying records or merchandise are sometimes made of plastic, but the plastic frame holds and displays only a single item in a frame, which frame is free to pivot on the stand without any self return to a preselected position.

SUMMARY OF THE INVENTION

An improved display device is provided whereby in one form, one or more revolving pedestals or carrousels can be stacked end-on-end in tandom on a base with each pedestal or carrousel having a plurality of radially projecting self-centering frames. In another form of display device, a vertically disposed rectangular-shaped stand is provided to support a plurality of transversely disposed frames. Each frame has a pair of oppositely facing pockets so as to display two posters at a time on each frame. Guide means are provided on the top and on the bottom of the frame for guiding the posters into and out of each pocket without bending, creasing, tearing or the like.

The frame is provided with cut out notches in the opposite edges of the top wall at the entry into the pockets which permit ready grasping of the outermost poster to peel the poster forward and to pull it out of the pocket.

Each frame has a specially designed pivot which coacts with openings formed in tapered surfaces of the stand so that the weight of the frame will always return the frame to a central position relative to the stand.

The improved display device is aesthetic, is balanced and when the frames are released, they will assume a radially outward projecting position.

BRIEF DESCRIPTION OF THE DRAWINGS

The details of construction and operation of the invention are more fully described with reference to the accompanying drawings which form a part hereof and in which like reference numerals refer to like parts throughout.

In the drawings:

FIG. 3 is a partial exploded perspective view of the pivot mount for one frame of the display;

FIG. 4 is an enlarged cross-sectional view taken along the line 4—4 of FIG. 3;

FIG. 5 is an enlarged cross-sectional view taken along the line 5—5 of FIG. 3;

FIG. 6 is a cross-sectional view taken along the line 6—6 of FIG. 3;

DESCRIPTION OF THE PREFERRED EMBODIMENT

Figure 2:
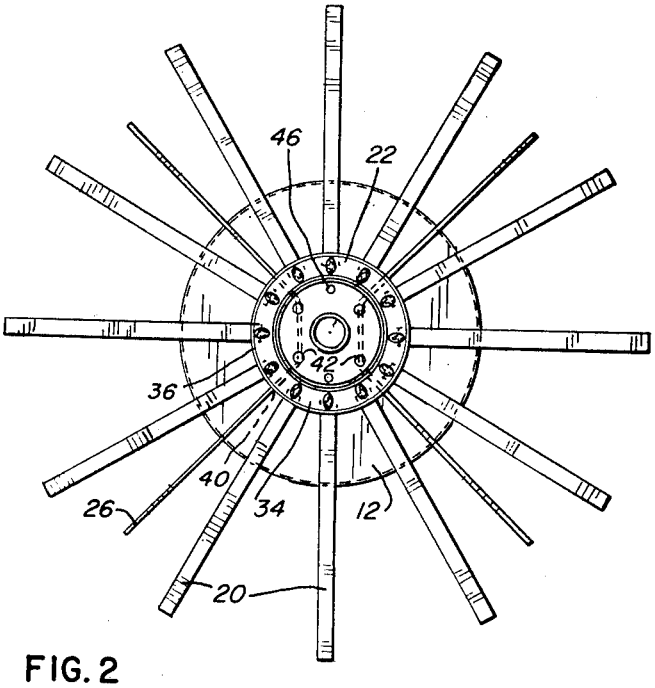
FIG. 2 is a top plan view of the display device of FIG. 1.
Figure 1:
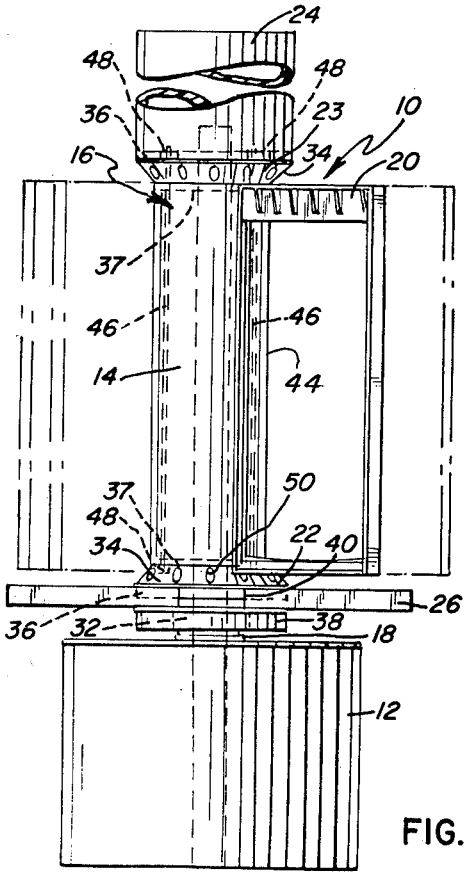
FIG. 1 is an elevational view of a revolving carrousel or pedestal self-service display device with the improved frame and frame pivoting arrangement.

Referring to FIGS. 1 and 2, a self-service revolving display device or stand 10 is illustrated and comprises a base 12 having a vertically extending shaft 14, a pedestal or carrousel 16 surrounding said shaft 14 and a lazy Susan-type revolving bearing 18 between the base 12 and the pedestal 16 whereby the pedestal or carrousel 16 is able to be revolved about the vertical axis of the shaft 14. A plurality of frame members 20 are pivotally mounted to spaced, conically-shaped hubs 22,23 of the pedestal 16. A cap 24 is carried by a portion of the hub 23 and is adapted to receive a display or advertising material thereon. Arms or handles 26 are secured in the lower hub 22, such that pressure on the arms 26 will revolve the pedestal or carrousel 16 about the vertical axis of the shaft 14.

Describing the display device or stand 10 more in detail, the lazy Susan-type revolving bearing 18 is secured to the top wall of the base 12 with the vertical shaft 14 extending from within the base 12 through the lazy Susan-type revolving bearing 18 and projects upwardly from the base 12. A bearing support 32 is secured to the shaft 14 and bears on the revolving part of the lazy Susan-type bearing 18. The pedestal or carrousel 16 is comprised of spaced facing hubs 22,23 which are identical in construction. As shown in FIG. 3, each hub has a conically-shaped portion 34 and oppositely extending cylindrically-shaped portions 36,37 integrally formed, respectively, with the large diameter and small diameter portions of the conically-shaped part 34. An open end of the cap 24 telescopes over the cylindrical portion 36 of the hub 23 and is fastened thereto for rotation with the hub. A cylindrically-shaped sleeve 38 engages with and encircles the bearing support 32 and mates with the cylindrical portion 36 of the hub 22 so that the bearing support 32, sleeve 38 and pedestal 16 all revolve with the shaft 14 on the lazy Susan revolving bearing 18 on the base 12. The arms 26, as can be seen in FIG. 2, project through slots 40 in the cylindrical portion 36 and sleeve 38 and are bent to pass through slotted lugs 42 on the hub 22. The material from which the arms 26 are made is relatively stiff so that they can have pressure applied to the outer end portion thereof as a means for rotating the pedestal or carrousel 16 relative to the base 12. A tubular member 44 encircles the shaft 14 and telescopes over the sleeve 37 on the lower hub 22. The upper hub 23, with the conical tapered portion 34 facing downward, is assembled with the tubular member 44 by inserting the sleeve 37 inside the end of said member 44. The hubs 22 and 23 are connected together by tie rods 46 passing through the hubs 22,23 and through the inside of the tubular member 44 and being secured by nuts 48 threaded on the ends of the tie rods 46.

A plurality of frames 20 are removably and pivotally seated in openings 50 formed in the facing conical portions 34 of the hubs 22,23 so that flat sheet material, such as posters, may be displayed by said frames 20.

The details of the one-piece molded frames 20 and the connection between the frames 20 and the hubs 22,23 are best illustrated in FIGS. 3 through 11. Each frame 20 is comprised of a continuous outer frame member having a top 61, a bottom 62 and two sides 63,64. The bottom 62 and the two sides 63,64 are a C-shaped channel in cross section. The channel is divided midway between the two extending arms or flanges 66,67 of the C-shape by a partition or wall 68 which projects inwardly a distance somewhat greater than the length of said arms or flanges 66,67 of the channel. The top 61 of the frame 20 extends between the two sides 63,64 and is T-shaped in cross section with the head 69 of the "T" joining with the base of the C-shaped sides 63,64 and with the leg 70 of the "T" extending toward the enclosed center of the frame and being joined at each end with the partition 68 formed in the sides 63,64 and bottom 62 of the frame 20. In this way, the partition 68 of the channel and leg 70 of the top 61 divides the frame 20 into two halves with each half acting as a pocket 72,73 for receiving flat material, such as posters 74 or the like.

The partition 68 across the bottom 62 of the frame 20 has end portions 71 projecting farther into the open center of the frame near the sides 63,64 than at the midportion of said bottom 62. The inner edge of the bottom partition slopes gradually on a curve from the end portions 71 to the midportion. The higher end portions 71 of the partition 68 act as guides to funnel flat material, such as posters 74 and the like, into the pockets 72 or 73 in the frame.

Figure 7:
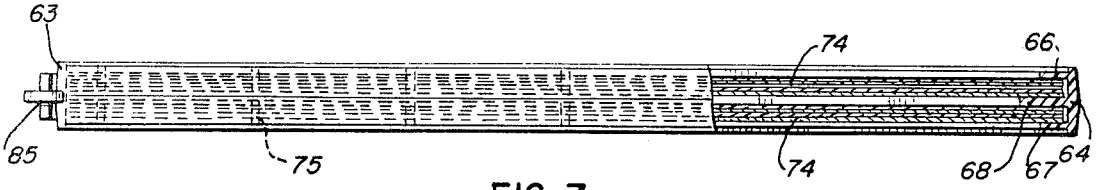
FIG. 7 is a plan view of a frame loaded with posters with part of the frame broken away and in section to illustrate the posters in the pockets of the frame.

For improving the ability to insert and remove posters from the pockets 72,73, a plurality of tapered guides or wedge-shaped members 75 extend between the head 69 of the "T" and the web or leg 70 of the "T" with the outer sloping edge 76 of the wedge-shaped member 75 aligning with and coinciding with the outwardly extending edge of the head 69 of the "T." In this way, flat sheets, such as posters 74, may be guided by the wedge-shaped guides 75 into each pocket 72 or 73 on the appropriate side of the frame 20. The posters 74, as shown in FIG. 7, are stored in the pockets 72,73 with the top edge portion overlapping or overlying the sloping edges 76 of the guides 75. To remove a poster 74, it is only necessary to grasp the top of the poster and as it is moved upward, the wedge-shaped guides 75 will divert the poster outwardly beyond the overhang of the head 69 of the T-shaped top whereupon the poster 74 can be readily removed from the pocket without bending, creasing, folding or the like. To reload posters 74 in the pockets 72,73 of the frame 20, the bottom edge of the poster 74 is placed against the edges 76 of the guides 75 whereupon the poster is threaded into the appropriate pocket. The end portions 71 of the partition 68 on the bottom of the frame will guide the bottom edge of the poster into the appropriate pocket. With the frame 20 divided into two pockets 72,73, it is possible to display two posters in each frame with one being viewed from each side of the frame.

To pivotally mount the frames 20 on the hubs 22,23 of the pedestal or carrousel 16, openings 50 are formed in the conical surfaces 34 of the top and bottom hubs 23,22 with the openings 50 appearing to be circular in shape when viewed from above along an axis through the center of the opening, which axis is parallel to the axis of the conical section of the hub. The openings 50 will be elliptical in shape when viewed transverse to the conical surface with the long or major axis 81 of the ellipse lying in a plane containing a radius of a circle centered on the axis of the conical section 34. A small dimple-like cutout 82 is formed in the lower end of the ellipse 80 and is centered on the major axis of the ellipse.

Figure 8:
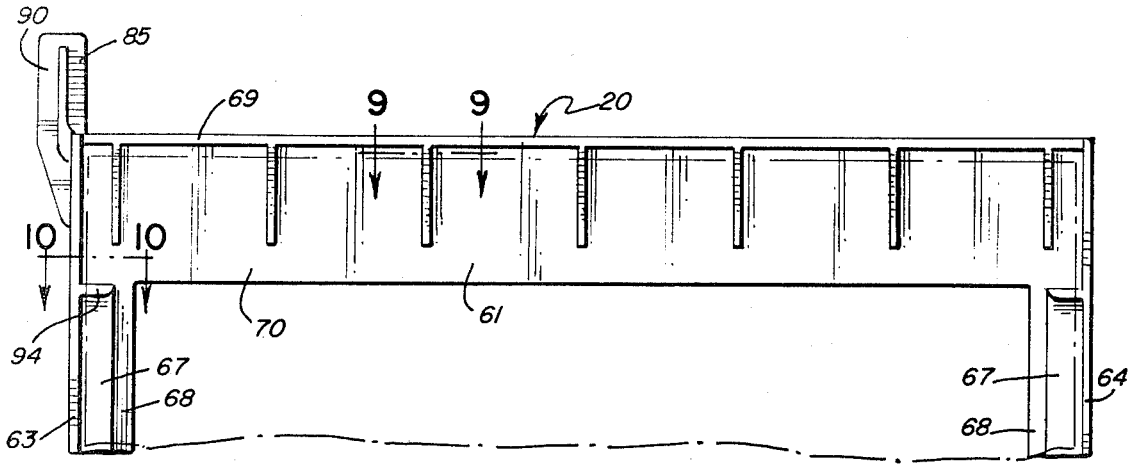
FIG. 8 is an elevational view of an improved frame.
Figure 8:
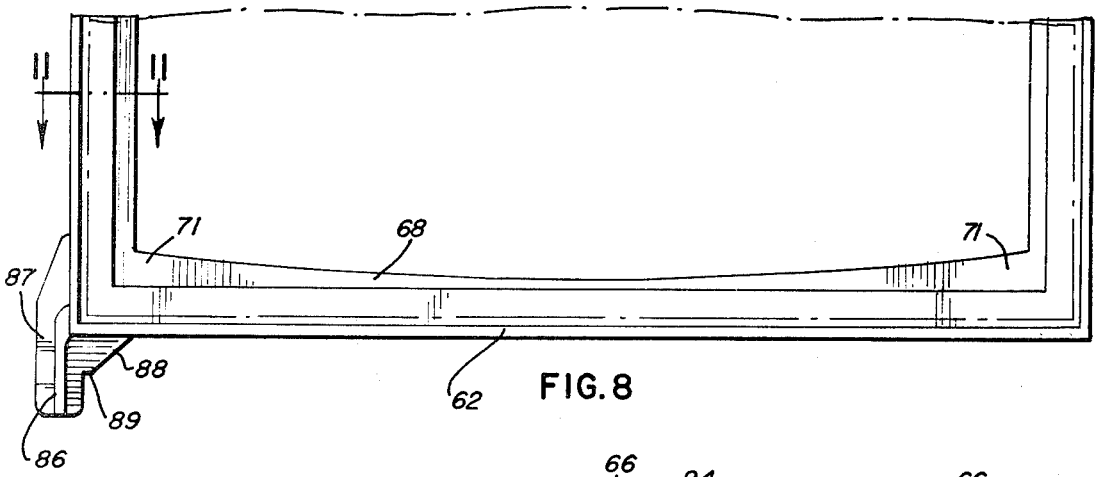
Figure 9:
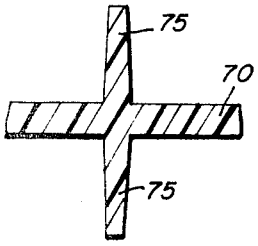
FIG. 9 is an enlarged cross-sectional view taken along the line 9—9 of FIG. 8.
Figure 10:
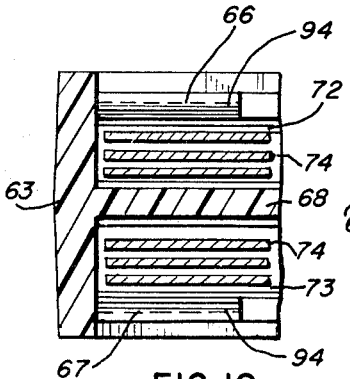
FIG. 10 is an enlarged cross-sectional view taken along the line 10—10 of FIG. 8 with sheets inserted.
Figure 11:
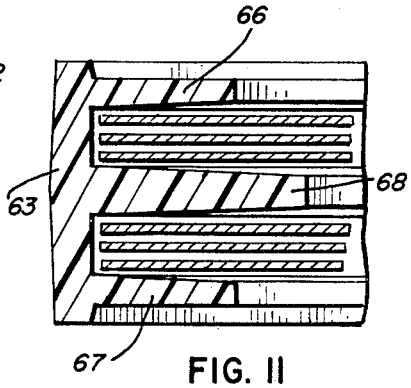
FIG. 11 is an enlarged cross-sectional view taken along the line 11—11 of FIG. 8 with sheets inserted.

Projecting upwardly and downwardly from the rear side wall 63 of the frame 20 are a pair of pivots 85,86 and, as can best be seen in FIGS. 3 and 5, the pivots have a cruciform cross section so that four equally spaced apart, radially equal length arms 87 project outwardly from the center portion thereof. As shown in FIG. 8, the lower pivot 86 has a sloping wall 88 merging with the one arm 87 with a slight shoulder intersecting with the sloping wall and with the vertical wall of the arm of the cruciform section to form the shoulder abutment 89 for the pivot 86. The upwardly extending pivot 85 contains four perpendicular radially equal length arms 90 with the one pair of arms 90 lying in the plane of the frame and extending a short distance above the ends of the other pair of arms 90.

With a frame 20 in hand, the upper pivot 85 is first threaded upwardly in one elliptical opening 50 in the tapered surface 34 of the top hub 23 and is moved upwardly until the top wall of the frame substantially engages with the tapered wall of the hub. The lower part of the frame with the lower pivot 86 is now moved so that pivot 86 aligns with a mating aligned elliptical opening 50 in the conical wall 34 of the lower hub 22 with the outer surfaces of the four cruciform arms 87 fitting in the opening 50. Upon releasing the frame, the weight of the frame will lower the frame relative to the hubs 22,23 of the pedestal until the shoulder abutment 89 on the one arm 87 of the cruciform section of the pivot engages with the dimple 82 in the bottom of the elliptical opening 50. The weight of the frame will hold the frame in the opening 50 in such a way that the shoulder abutment 89 stays seated in the dimple 82. Upon forcibly turning the frame 20 about the vertical axes of the pivots 85,86, the frame will raise as it is turned as the shoulder abutment 89 on the one cruciform arm 87 rides up the top surface of the edge of the elliptical opening 50. Upon releasing the frame, the weight of the frame will cause the shoulder abutment 89 to ride down the edge of the wall of the elliptical opening 50 until the shoulder abutment 89 drops into the dimple 82 at the low point of the opening 50. Due to the weight of the frame, the frame will be held in a radially extending position such that a plane passing through the vertical center of the frame will pass through the axes of the pivots 85,86 and through the axis of the pedestal 16.

From the above, it can be seen that flat material, such as posters 74, can be fed into the two pockets 72,73 formed on the opposite facing sides of the frame 20. All of the frames 20 will be loaded with oppositely facing pairs of posters until the whole carrousel arrangement has been loaded. With the display device on a counter or mounted on a floor in a sales area, a customer can push on the handle 26 to revolve the pedestal or carrousel 16 on the lazy Susan revolving bearing 18 about the vertical axis of the pedestal 16. Individual posters 74 in individual pockets 72,73 of each frame 20 can be viewed by pivoting the frame about the vertical axes of the pivots 85,86 of the frame. Upon selecting a poster 74, the customer can thread the poster out of the pocket of the frame by guiding the poster up the sloping edge 76 of the wedge-shaped guides 75 at the top of the pocket of the frame. Upon the customer releasing the frame, the frame will immediately reassume a radial position with respect to the axis of the pedestal. In this way, the display device will always have a symmetrical appearance to the viewing public with each frame being equally spaced from the adjacent frames and each side of each frame displaying a different poster. The handles 26 can be used to turn the pedestal or carrousel 16 relative to the base 12, or can be used to hold the carrousel 16 while an individual frame 20 is pivoted about its axis for closer scrutiny of the contents of the poster 74 in the frame 20.

Figure 12:
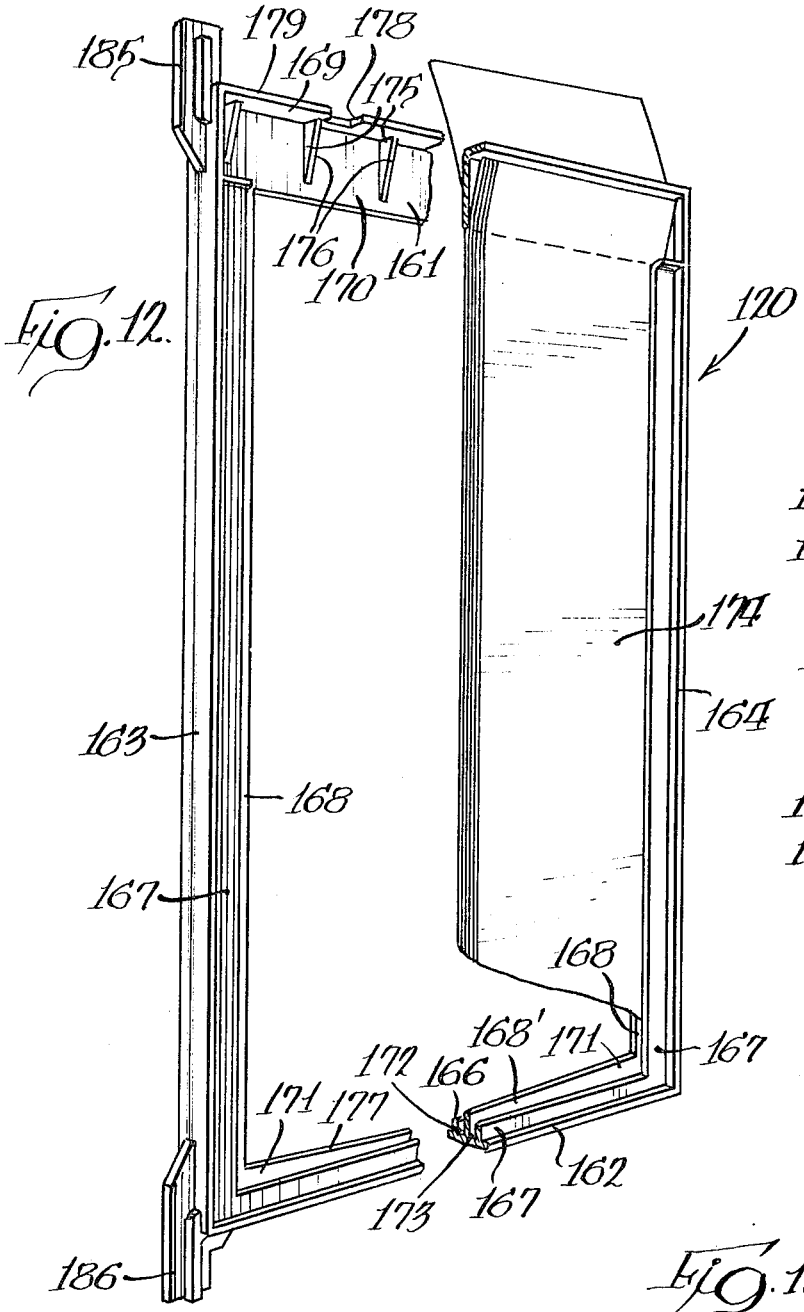
FIG. 12 is a partial perspective view of a modified form of frame of the display.
Figure 14:
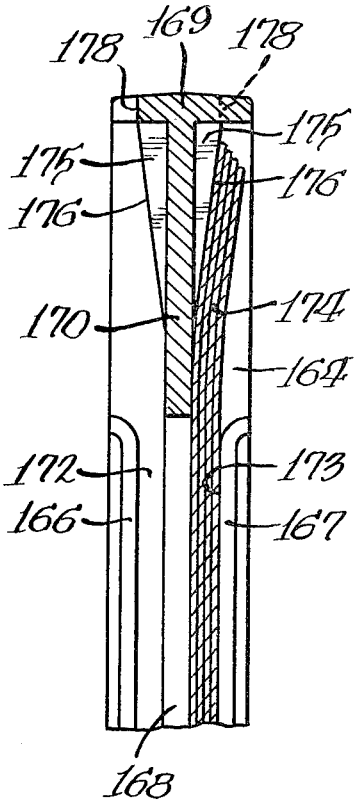
Figure 13:
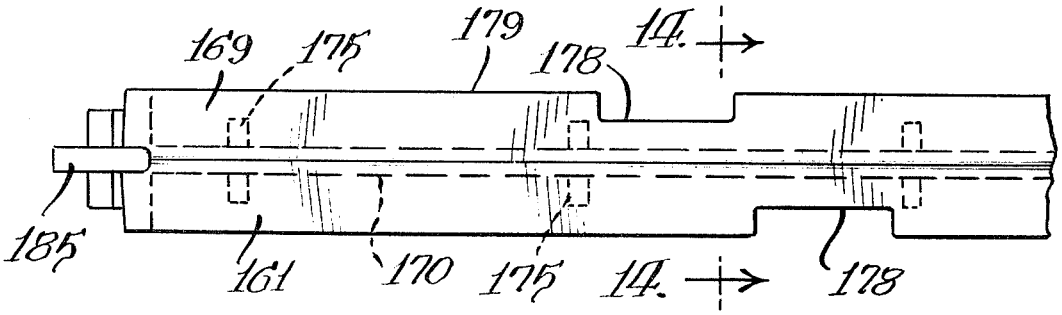
FIG. 13 is a partial top view of the modified frame of the frame of FIG. 12; and, FIG. 14 is a partial cross-sectional view taken along the lines 14—14 of FIG. 13 with sheets inserted.

FIGS. 12 through 14 illustrate an improved form of a one-piece molded frame member 120 having four sides or walls 161, 162, 163 and 164. As shown, side or wall 161 is a top wall which forms the entry into the frame. The side or wall 162 is a bottom wall and the two vertical sides or walls 163, 164 connect the bottom wall to the top wall. The bottom wall 162 and the two vertical side walls 163, 164 have a shape that, in cross section, is a C-shaped channel. The channel is divided between the two extending arms or flanges 166, 167 of the C-shape by a partition or wall 168 which projects inwardly a distance somewhat greater than the length of said arms or flanges 166, 167 of the channel. The partition 168 across the bottom wall 162 of the frame 120 forms a second guide 168' which has end portions 171 projecting farther into the open center of the frame near the sides 163 and 164 than at the midportion of said bottom wall 162. The inner edge 177 of the guide 168' on the bottom wall, slopes gradually on a concave curve from each end portion 171 to the midportion. The higher end portions 171 of the partition 168 act as guides for funneling flat members, such as posters 174, and the like, into the pockets 172 and 173 formed between the partition and the extending arms or flanges 166 and 167.

The top wall or entry 161 into the frame 120 extends between the two sides or walls 163 and 164 and is T-shaped in cross section with the top or head 169 of the "T" joining with the base of the C-shaped sides 163 and 164 and with the leg 170 of the "T" extending toward the enclosed center of the frame and being joined at each end with a partition 168 formed in the sides 163 and 164 and bottom 162 of the frame 120. In this way, the partition 168 of the channel and the leg 170 of the top wall 161 divides the frame 120 into two halves with each half acting as a pocket 172 and 173 for receiving flat members, such as posters 174, or the like.

Each side of the head 169 of the "T" has a cut out notch 178 formed in from the outer edges 179 thereof. The notches 178, as illustrated, are rectangular in cross section with the bottom of the notch lying in a plane which substantially aligns with the sloping edges 176 of the guides 175 extending between the head 169 of the "T" and the web or leg 170 of the "T." That is, the outer sloping edge 176 of the wedge-shaped guides 175 fall in a plane which aligns with the base wall of the notch 178 formed in each side of the "T." The plane containing the sloping edges 176 of the wedge-shaped guide 175 falls inboard of the outer edge of the head 169 of the "T." In use, a party desiring a poster can reach through the cut out notches 178 and grasp the top edge of the outermost poster 174. The poster is peeled forward to clear the outer edge of the head 169 of the "T." The sloping edges 176 of the guides 175 assist in directing the top edge of the poster toward the removing position. Once the edge of the poster has cleared the outer edge of the head 169 of the "T," it can be lifted and slid out of the respective pocket of the frame.

It is to be understood that the notches 178 could extend all the way to the base of the "T" and no guides 175 would then be present between the leg of the "T" and the head of the "T" 169. Since the notches 178 are relatively close to one corner of the frame, the user can reach through the notch, grasp the outermost poster, peel the corner away from and out from beneath the head 169 of the "T" and then slide the poster up and out of the pocket.

In loading posters 174 into the respective pockets 172 and 173, one or more posters are threaded into the entry opening between the flanges 166 or 167 and the partitions 168 by guiding the bottoms of the posters against the guides 175 and into the respective pockets. As the posters 174 approach the bottom of the frame, they will have a tendency to bow in the middle of the poster. The guide 168' with the raised end portions 171 and the edge 177 will engage the bottom edges of the posters and, due to the slope of the guide 168', will urge the center of the poster into a planar shape so that the whole bottom edge of the poster will drop into the pocket. The curved edge 177 of the guide 168' at the bottom 162 of the frame, will guide the posters into the proper and appropriate partitioned off area.

Each frame 120 will have upwardly and downwardly projecting pivots 185 and 186. The pivots are cross shaped or cruciform shaped in configuration and are formed integrally with the frame in the same manner as previously described. The pivots 185 and 186 may be inserted in openings in a horizontal stand or in openings in a carrousel-type stand and, depending upon the shape of the openings and the slope of the member in which the openings are formed, the frame can be self-centering or can be freely pivoted as the case may be. That is, if the member containing the openings in the stand is flat and lies substantially parallel to the horizontal, the pivots 185 and 186, when inserted in said openings, will pivotally mount the frame so that the frame can be flopped from one side to the other freely. In the event the member in which the openings are formed is sloped with respect to the horizontal, the pivots 185 and 186, when engaged in the openings in the sloping member, will have a tendency to center the frame in a transverse, outwardly extending position relative to the stand. This is due to the coaction between the cross form of the pivot and the particular oval shape of the openings in the member as described with respect to FIGS. 1 through 11.

I claim:

1. A frame for holding a plurality of flexible display panels comprising a molded plastic outer frame having on three sides thereof an inwardly opening channel which is C-shaped in cross section, the fourth side of the frame having a T-shape in cross section with the leg of the "T" projecting inwardly toward the center of the frame, a divider molded integrally with the back of the C-shaped channel and projecting inwardly from between the two legs of the C-shaped channel, said divider joining with said leg of the "T" to divide the frame into two pockets with several of said flexible display panels being capable of being nested in each of said pockets, a cut out notch formed in at least one side edge of the head of the "T" to expose the outer edges of the plurality of flexible display panels in said adjacent pocket, and guide means extending between the head of the "T" and the leg of the "T," said outermost flexible display panel may be grasped through said cut out notch and peeled forward and guided out of said adjacent pocket.

2. In a frame for displaying the outer sheet of two oppositely facing stacks of sheets of material on opposite sides thereof, said frame having four walls comprised of molded plastic, three of said walls comprised of an inwardly open channel member having a C-shape in cross section, a divider molded integrally with the back of the C-shaped channel and projecting inwardly from between the two legs of the C-shaped channel, the fourth wall of the frame having a T-shape in cross section with the leg of the "T" projecting inwardly toward the center of the frame and joining said divider to divide the frame into two oppositely facing pockets, each pocket receiving one of said stacks of sheets of material, in combination a cut out notch formed inwardly from an outer edge of the head of the "T" to form an opening through which the outer edges of the stack of sheets of material are exposed, said notch having a base wall spaced inward from the outer edge of the head of the "T" and spaced outward from the leg of the "T," and guide means extending between the head of the "T" and the leg of the "T" to form a guide surface, said guide surface aligning with the base wall of the notch whereby the outer edge of the outermost sheet of material is grasped through the notch and is peeled forward and pulled out of the pocket.

* * * * *